US010463951B1

(12) United States Patent
Su

(10) Patent No.: US 10,463,951 B1
(45) Date of Patent: Nov. 5, 2019

(54) VERTICALLY STACKED EDUCATIONAL BUILDING BLOCK DEVICE

(71) Applicant: Lonpos Braintelligent Co., Ltd, New Taipei (TW)

(72) Inventor: Ping-Hung Su, New Taipei (TW)

(73) Assignee: Lonpos Braintelligent Co., Ltd, New Taipei (TW)

( * ) Notice: Subject to any disclaimer, the term of this patent is extended or adjusted under 35 U.S.C. 154(b) by 0 days.

(21) Appl. No.: 16/264,697

(22) Filed: Feb. 1, 2019

(51) Int. Cl.
*A63F 9/00* (2006.01)
*A63F 9/06* (2006.01)

(52) U.S. Cl.
CPC ..... *A63F 9/0073* (2013.01); *A63F 9/06* (2013.01)

(58) Field of Classification Search
CPC ..... A63F 3/00
See application file for complete search history.

(56) References Cited

U.S. PATENT DOCUMENTS 4,022,473 A * 5/1977 Foley ..... A63F 3/00082 273/265
4,277,067 A * 7/1981 Gettleman ..... A63F 3/00075 273/271
4,381,112 A * 4/1983 Dupuy ..... A63F 3/00094 273/239
4,432,554 A * 2/1984 Beamon ..... A63F 3/00075 273/272
4,585,234 A * 4/1986 Alsip ..... A63F 3/00094 273/271
5,265,885 A * 11/1993 Blount ..... A63F 9/34 273/239
5,788,236 A * 8/1998 Goldfarb ..... A63F 7/0076 273/153 S
6,702,285 B2 * 3/2004 Cheng ..... A63F 9/12 273/153 R
7,810,814 B1 * 10/2010 Chapman ..... A63F 3/00094 273/236
2010/0096806 A1 * 4/2010 Hextall ..... A63F 3/00 273/271
2014/0159309 A1 * 6/2014 Jiang ..... A63F 3/00634 273/271

* cited by examiner

*Primary Examiner* — Eugene L Kim
*Assistant Examiner* — Christopher Glenn

(57) ABSTRACT

A vertically stacked educational building block device, which comprises a base, a building block base, a building block set and at least one picture card. The building block base comprises a bottom wall, several parallel and equidistantly arranged grid bars on two sides of top end of bottom wall, two sidewalls located at both ends of bottom wall and two top bars connected to the top end of grid bars and sidewalls. The building block device can be combined with a picture card to generate another game mode, which can be played by two persons together, so as to enhance the content and gameplay of the game, the building block game is more diversified, the fun of is enhanced, exciting the interest and benefit of play.

8 Claims, 16 Drawing Sheets

VERTICALLY STACKED EDUCATIONAL BUILDING BLOCK DEVICE

BACKGROUND OF INVENTION

1. Field of the Invention

The present invention relates generally to a Tetris-based vertically stacked educational building block device for one or two persons to play.

2. Description of Related Art

The applicant of this project has developed multiple building blocks with educational game function, such as Taiwan patent notification numbers M535588, M429514, I370010 and M409879. There is not a three-dimensional stacking method similar to Tetris among the previous educational building blocks, and the original building block structure has been complex, the production cost has been high, additional elements will undoubtedly increase the unit price of goods, that is disadvantageous to consumers. On the other hand, only the aforesaid patent M535588 provides a box for storage, the other educational building blocks only provide a tray for storage, so when they are carried to the outside, additional containers are required for storage to avoid losing the building blocks, that is time consuming and inconvenient, the players are sometimes unlikely to carry them. The patent M535588 has a box for storage, but the game cannot be played by the three-dimensional stacking method of Tetris. Therefore, the purpose of the present invention is to overcome the above problems, so as to make the building block game more changeful and challenging.

SUMMARY OF THE INVENTION

In order to solve the above technical problems, the present invention adopts the following technical solutions:

The technical scheme is to provides a vertically stacked educational building block device, comprising:

a base, including a bottom board; front and back sidewalls upright on the front and back sides of the bottom board; and left and right sidewalls upright and connected to the front and back sidewalls on the right and left sides of the bottom board; wherein the front and back sidewalls include a plurality of protruding stoppers disposed thereunder; the back sidewall includes a handle, and two ends of the handle are integrally formed with the left and right side walls of the base, so that a receiving groove is formed between the handle and back sidewall;

a building block base, which can be placed in the base, and withstood by the stopper, so that the building block base is spaced from the bottom board to form a holding space, and the building block base including a bottom wall; wherein the building block base includes a bottom wall, a plurality of parallel and equidistantly arranged grid bars located on two sides of a top end of the bottom wall, two sidewalls located at both ends of bottom wall, two top bars connected to a top end of the grid bars and sidewalls, and a retaining wall protruding from an inner wall of the grid bars; the retaining wall forms a plurality of guide slots between two rows of grid bars, one end of the guide slot is the slot opening, and another end is sealed by the bottom wall;

a building block set, including a plurality of building blocks vertically located in the guide slot of the building block base; wherein the building block contains at least one block unit; the block units are connected by a narrow neck, so a groove is formed between the block units, so that the building block can be moved vertically in the guide slot with the groove and the retaining wall on two rows of grid bars; and at least one picture card, which can be laid in the holding space, and at least one pattern is printed on a surface of picture card.

More particularly, wherein one end of the left and right sidewalls near the front sidewall includes arc-like first and second embedding grooves respectively; the first and second embedding grooves includes vertically connected transverse grooves and longitudinal grooves respectively; a first and second locating pieces corresponding to the first and second embedding grooves protrude from both ends of the sidewall of the building block base respectively, the first and second locating pieces can be embedded in the first and second embedding grooves respectively, so that the building block base can be slid into the base via the first and second embedding grooves, and vertically swayed toward the grip to be placed flat in the base.

More particularly, wherein a third and fourth embedding grooves are located in the left and right end walls of the receiving groove respectively, and the first and second locating pieces at both ends of sidewall can be embedded in the third and fourth embedding grooves respectively, so that the building block base can stand upright in the receiving groove between the handle and back sidewall.

More particularly, wherein a first and second baffles extend inward at the bottom of left and right end walls of the receiving groove respectively; the first and second baffles can be propped the bottom of building block base respectively, so that the building block base is supported by the first and second baffles to stand upright in the receiving groove.

More particularly, wherein a first and second stoppers corresponding to the third and fourth embedding grooves which can be embedded in the third and fourth embedding grooves protrude from the bottom of the handle respectively, and a third stopper protrudes from four corners at the bottom of the bottom board respectively, and an arc angle corresponding to the third stopper for embedding the third stopper is located at four corners on the surface of building block base respectively.

More particularly, wherein at least one anti-slip lug protrudes from the bottom of the left and right sidewalls respectively.

More particularly, wherein a clamping block protrudes from the inner wall of back sidewall of the base, the clamping block can clamp the top bar on one side of the building block base, so that the building block base is fixed into the base, and the clamping block is an arc-like projection.

More particularly, wherein each surface of the block unit is recessed inwardly to form a groove for finger movement.

According to the aforesaid implementation, the present invention has the following benefits:

1. The building block set of the present invention can move vertically in the guide slot of building block base, forming a play similar to Tetris game, so that the building block game is more changeful to implement the educational function of fun games and brain storming.

2. The implementation of building block A+picture cards of the present invention can generate another game mode, which can be played by two persons together, so as to enhance the content and gameplay of the game to excite the user's interest.

3. The present invention combines the third and fourth embedding grooves in the base with the first and second locating pieces on the building block base, when the player is to play the game, as long as the first and second locating pieces at both ends of building block base are embedded in the third and fourth embedding grooves in the base respectively to make the building block base upright in the receiving groove of base, and then the game can begin. On the contrary, the building block base can be pulled out after play, and the first and second locating pieces at both ends of building block base are embedded in the first and second embedding grooves in the base respectively, and then the building block base is turned towards the handle and laid in the base, the storage is completed, quite convenient. In addition, the integration of handle and base is portable for players to carry.

DETAILED DESCRIPTION OF THE INVENTION

The detailed description is given below according to the attached figures.

Figure 1:
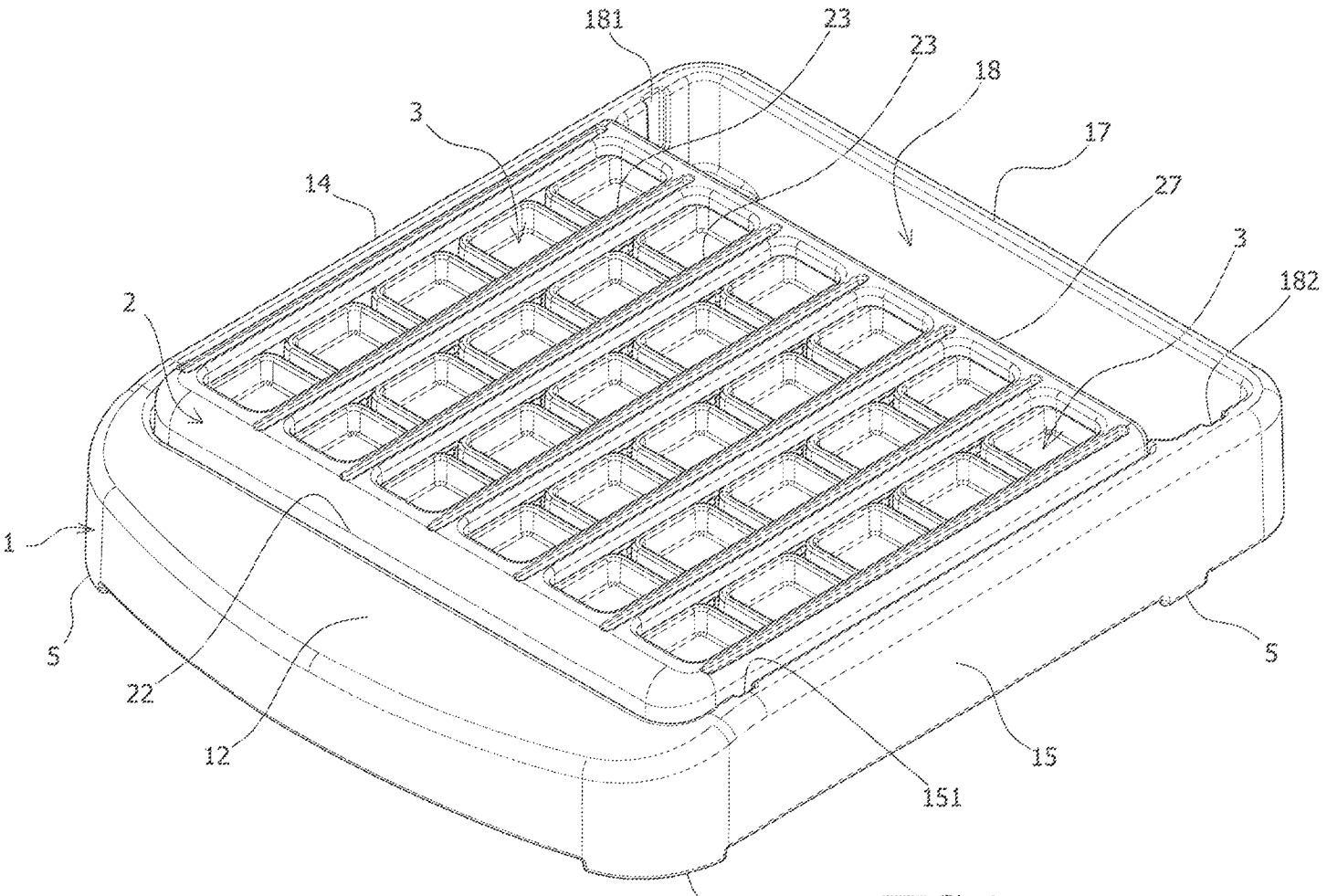
FIGS. 1 and 2 are perspective views of the present invention.
Figure 2:
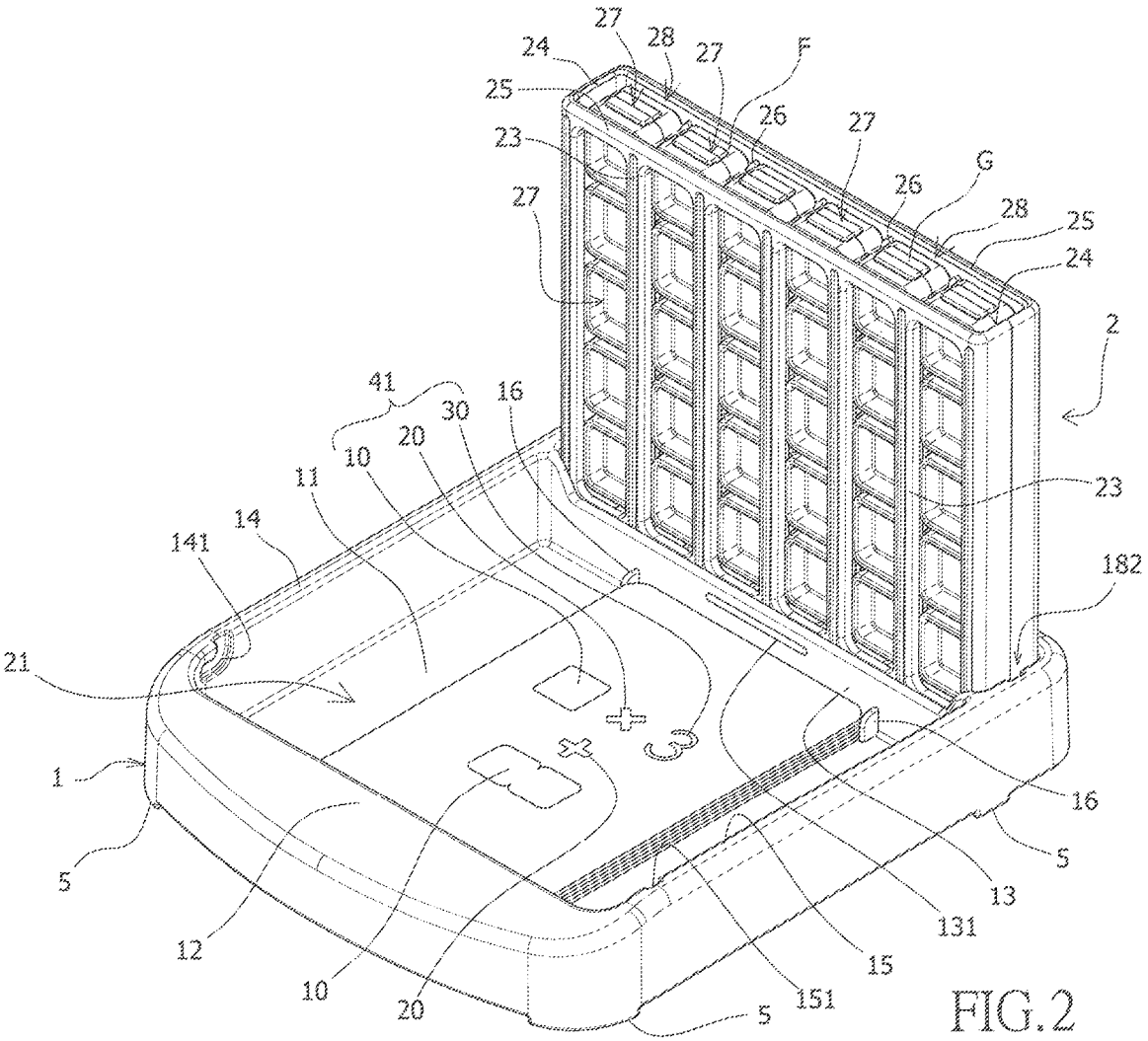
Figure 3:
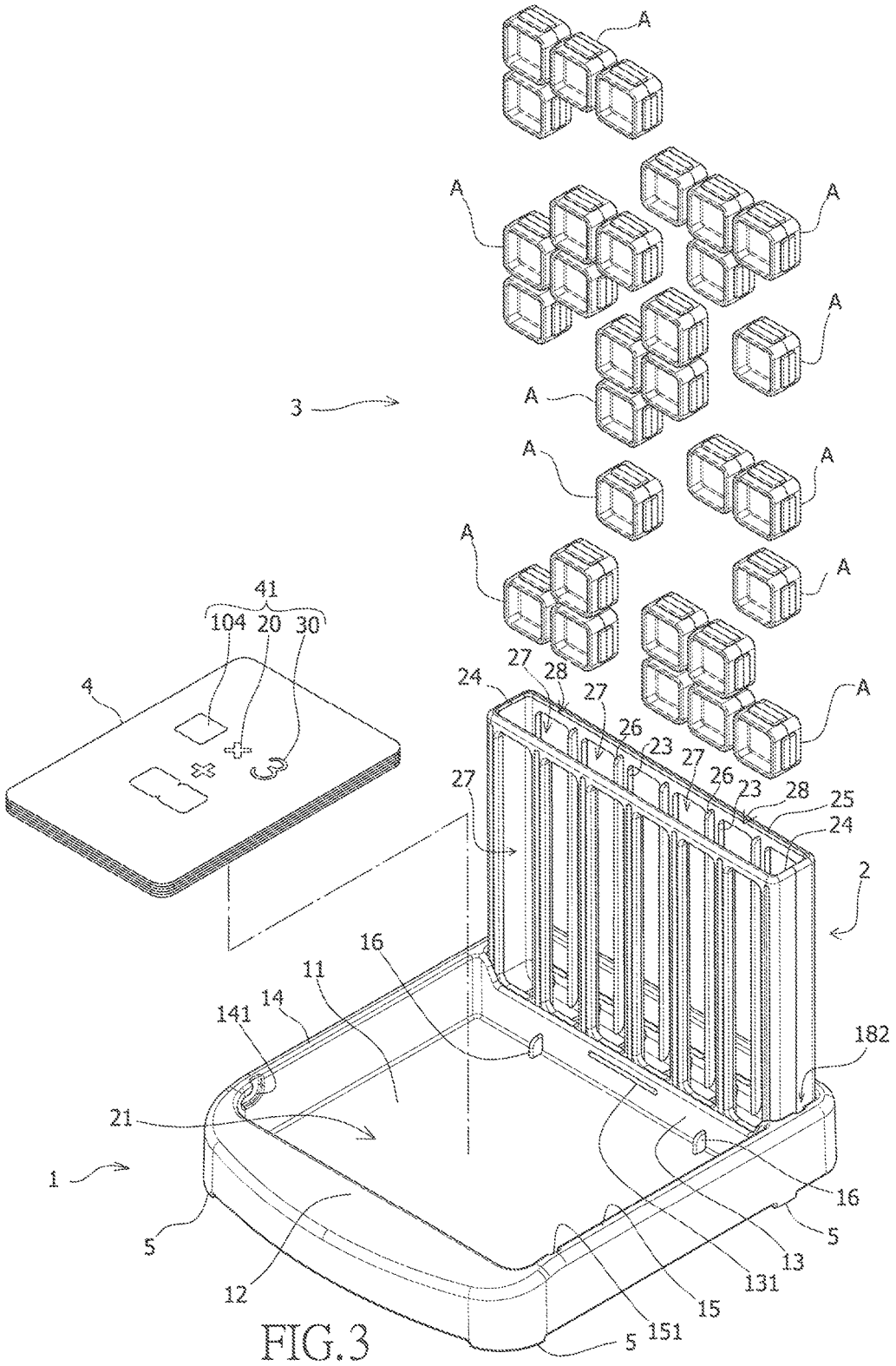
FIG. 3 a perspective view of a building block standing upright on a base.
Figure 4:
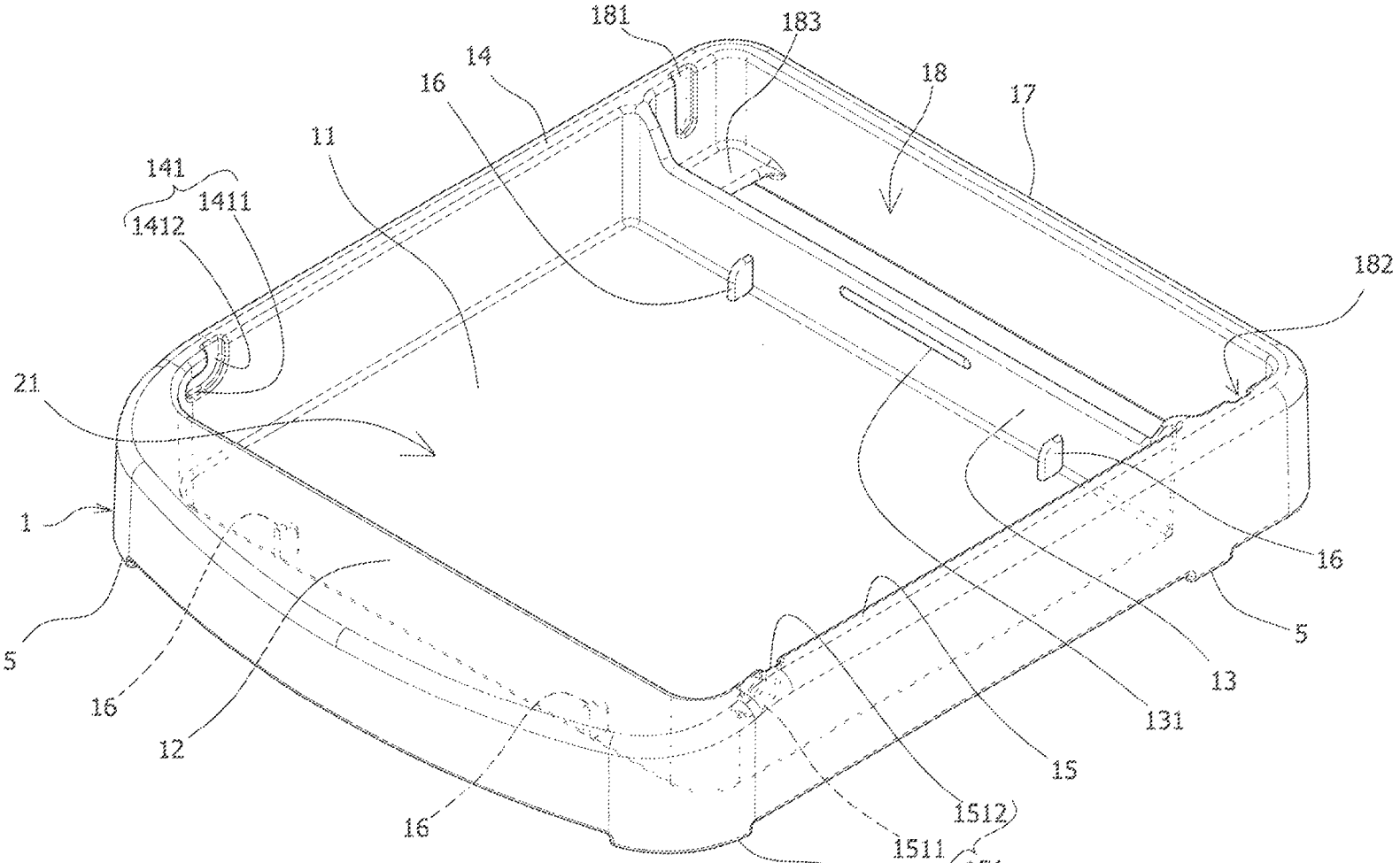
FIG. 4 is a perspective view of the base of the present invention.

FIGS. 1~3 disclose a vertically stacked educational building block device, which comprises a base 1, a building block base 2, a building block set 3 and at least one picture card 4, the structure thereof is described below:

Base 1, please refer to FIG. 4, comprising a bottom board 11; the front and back sidewalls 12, 13 upright on the front and back sides of bottom board 11; and the left and right sidewalls 14, 15 upright and connected to the front and back sidewalls 12, 13 on the right and left sides of bottom board 11. There are several prominent stoppers 16 in the lower part of the front and back sidewalls 12, 13, and the back sidewall 13 is provided with a handle 17, both ends of the handle 17 are integrated with the left and right sidewalls 14, 15 of base 1, so that a receiving groove 18 is formed between the handle 17 and the back sidewall 13.

Figure 5:
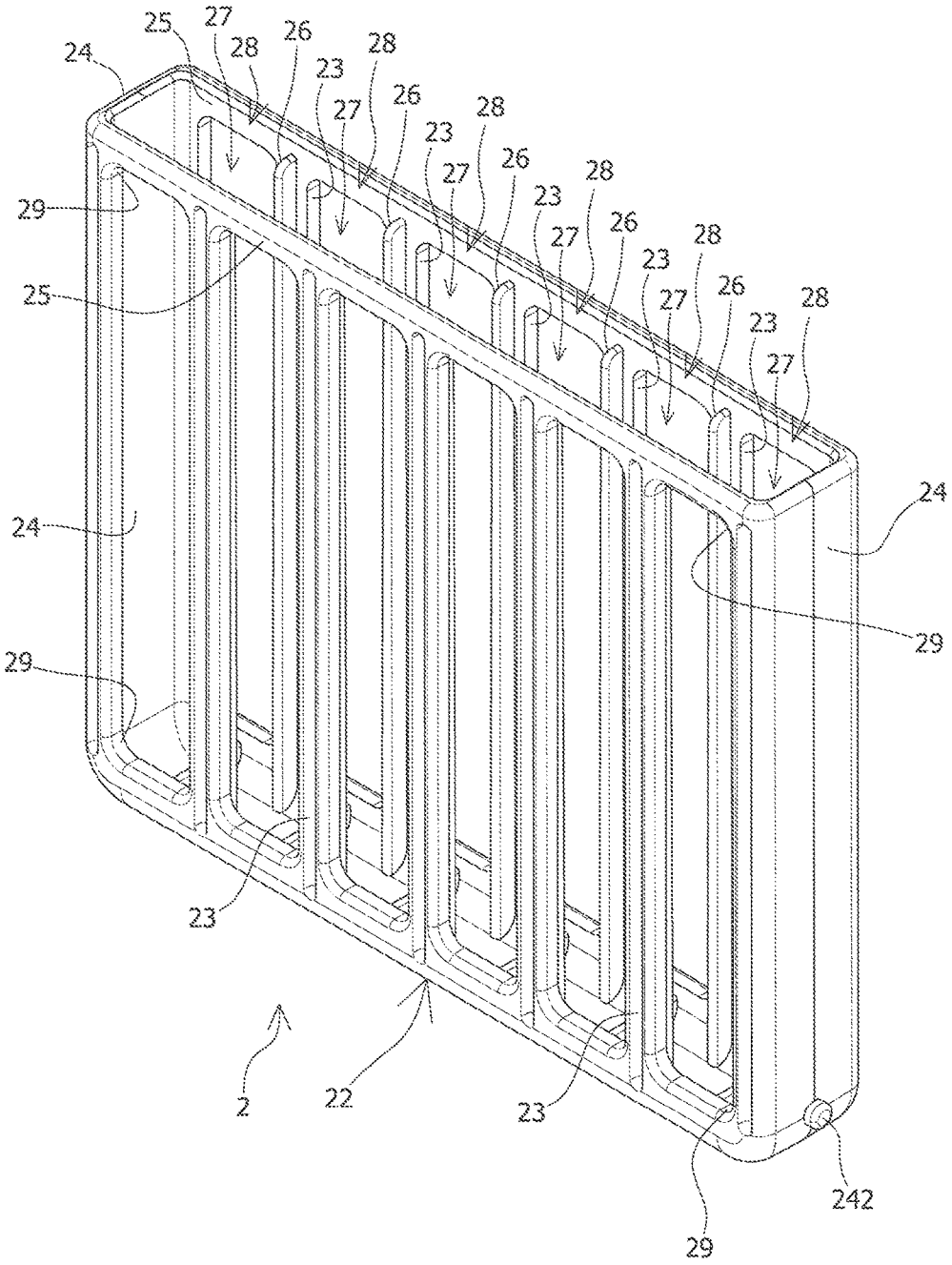
FIG. 5 is a perspective view of the building block base of the present invention.

Building block base 2, please refer to FIG. 5, can be placed in the base 1, and withstood by stoppers 16, so that the building block base 2 is spaced from the bottom board 11 to form a holding space 21. The building block base 2 comprises a bottom wall 22, several parallel and equidistantly arranged grid bars 23 located on two sides of top end of bottom wall 22, two sidewalls 24 located at two ends of bottom wall 22, and two top bars 25 connected to the top end of grid bars 23 and sidewalls 24. A retaining wall 26 protrudes from the inner wall of the grid bars 23, the retaining wall 26 forms several guide slots 27 between two rows of grid bars 23. One end of the guide slot 27 is slot opening 28, the other end is sealed by bottom wall 22.

Building block set 3, please refer to FIG. 3, comprising several building blocks A vertically located in the guide slot 27 of building block base 2. The building block A contains at least one block unit 10. The block units 10 are connected by a narrow neck 101, so a groove 102 is formed between block units 10, and the building block A can move vertically in the guide slot 27 with the groove 102 and the retaining wall 26 on two rows of grid bars 23, forming a play similar to Tetris game, the building block game is more changeful, implementing the educational effect of fun games and brain storming. The play of the game will be further described in FIG. 15.

Picture card 4, please refer to FIG. 3, one or multiple cards can be laid in the holding space 21, and at least one pattern 41 is printed on the surface of each picture card 4. The pattern 41 uses 1 to 5 patterns 104 approximating block unit 10 and symbol 20 and number 30 as subject, so another game mode is generated, which can be played by two persons together, so as to enhance the content and gameplay of game. The play of the game will be further described in FIGS. 16 and 17.

Figure 6:
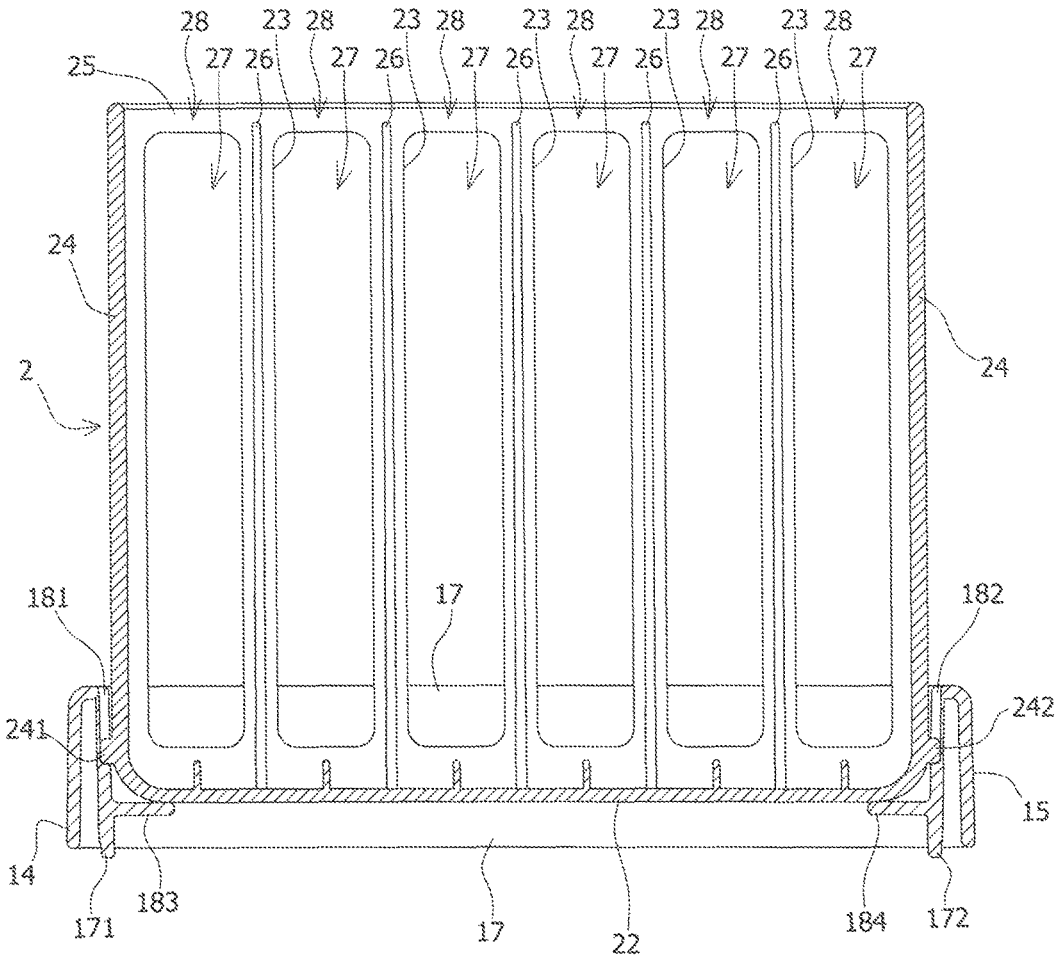
FIG. 6 is a schematic cross-sectional view of the building block base of standing upright on the base.

As shown in FIGS. 4~6, the third and fourth embedding grooves 181, 182 are located in the left and right end walls of the receiving groove 18 respectively, and the first and second locating pieces 241, 242 corresponding to the third and fourth embedding grooves 181, 182 protrude from both ends of sidewalls 24 of building block base 2 respectively. The first and second locating pieces 241, 242 can be embedded in the third and fourth embedding grooves 181, 182 respectively, so that the building block base 2 can stand upright in the receiving groove 18 between the handle 17 and the back sidewall 13. Thus, when the player is to play the game, as long as the first and second locating pieces 241, 242 at both ends of building block base 2 are embedded in the third and fourth embedding grooves 181, 182 in the base 1 respectively, the building block base 2 stands upright in the receiving groove 18 of base 1, and then the game begins. A first and second baffles 183, 184 extend inward at the bottom of left and right end walls of the receiving groove 18 respectively. The first and second baffles 183, 184 can prop the bottom of building block base 2 respectively, so that the building block base 2 can be supported by the first and second baffles 183, 184 to stand upright in the receiving groove 18, so as to enhance the stability of building block base 2 to avoid it falling down due to impact in the game.

Figure 7:
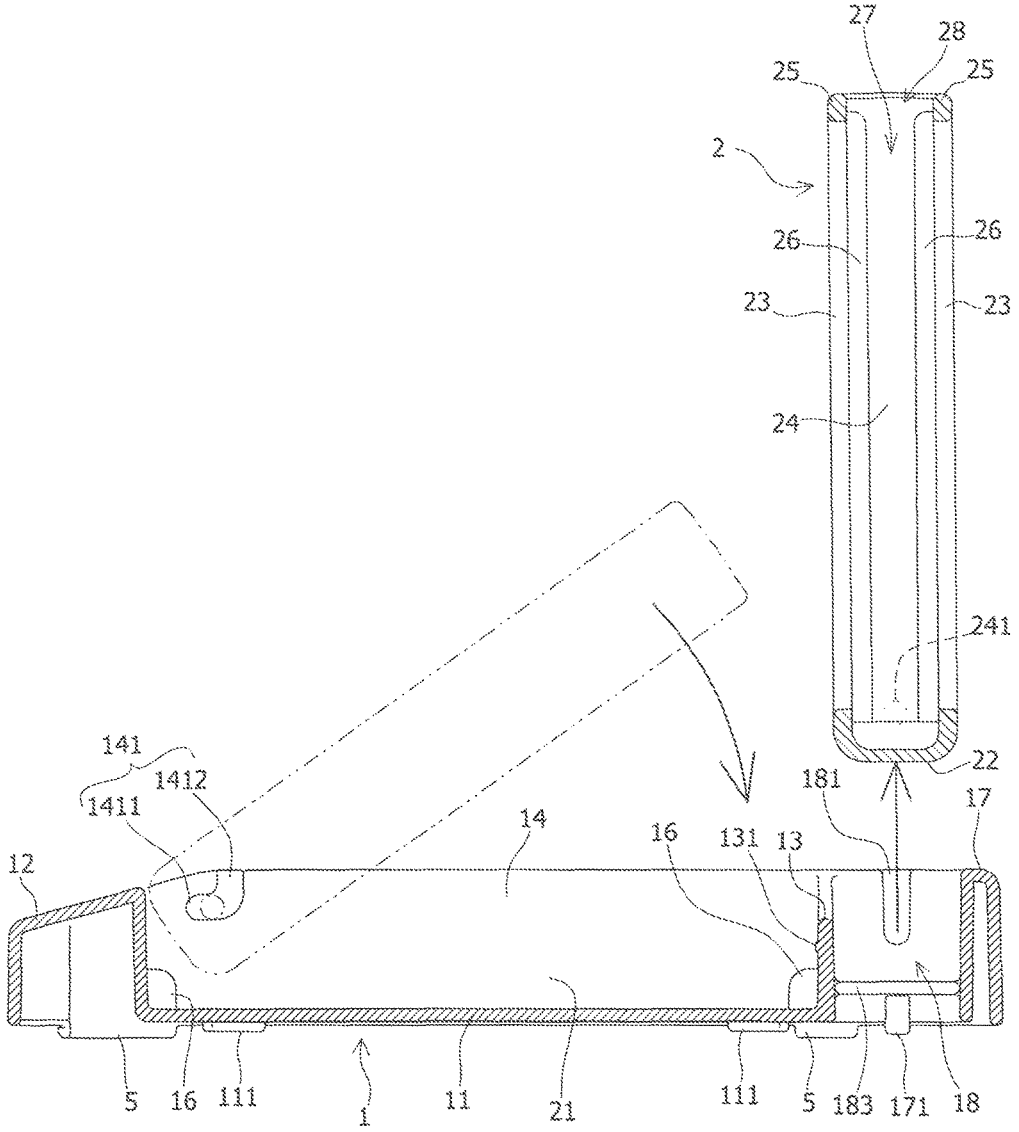
FIG. 7 is a schematic view showing the implementation of the present invention when it is stored.

Secondly, please refer to FIG. 4, one end of the left and right sidewalls 14, 15 near the front sidewall 12 is provided with a first and second embedding grooves 141, 151, and a first and second locating pieces 241, 242 corresponding to the first and second embedding grooves 141, 151 protrude from two ends of sidewalls 24 of the building block base 2 respectively. The first and second locating pieces 241, 242 can be embedded in the first and second embedding grooves 141, 151 respectively. As the first and second embedding grooves 141, 151 comprise vertically connected transverse grooves 1411, 1511 and longitudinal grooves 1412, 1512 respectively, the first and second embedding grooves 141, 151 are cambered. Therefore, when the building block base 2 slides in base 1 via the first and second embedding grooves 141, 151, it can be swayed towards handle 17 and laid in base 1. Please refer to FIG. 7, when the player stops playing the game, as long as the building block base 2 is pulled out of the receiving groove 18, and the first and second locating pieces 241, 242 at both ends of building block base 2 are embedded in the first and second embedding grooves 141, 151 in the base 1 respectively, and then the building block base 2 is swayed towards handle 17 and laid in base 1, the storage is completed, quite convenient.

Figure 8:
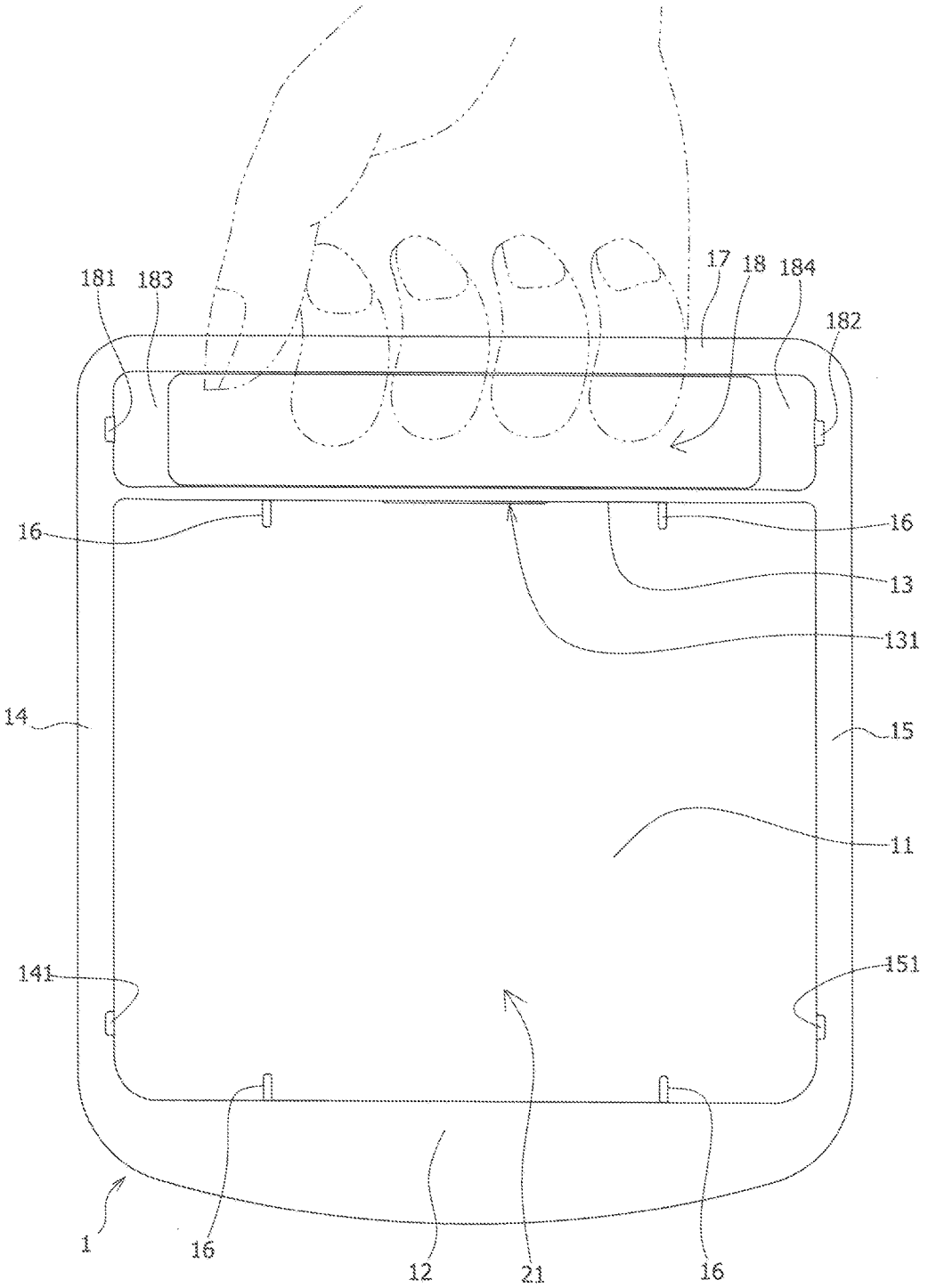
FIG. 8 is a schematic view showing the implementation of the present invention when it is carried.

Furthermore, please refer to FIG. 8, the integrated forming of handle 17 and base 1 is convenient for the player to carry with, and it can be placed on the table top for game at any time.

Figure 9:
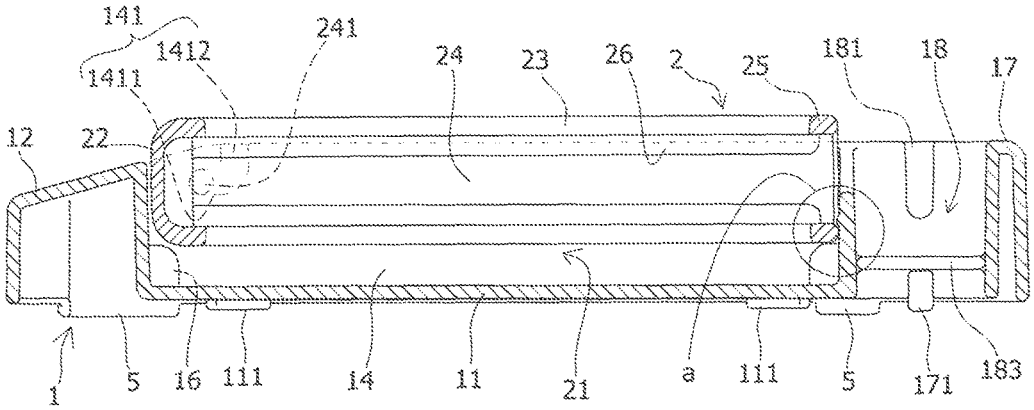
FIG. 9 is a schematic cross-sectional view of the present invention after storage.
Figure 10:
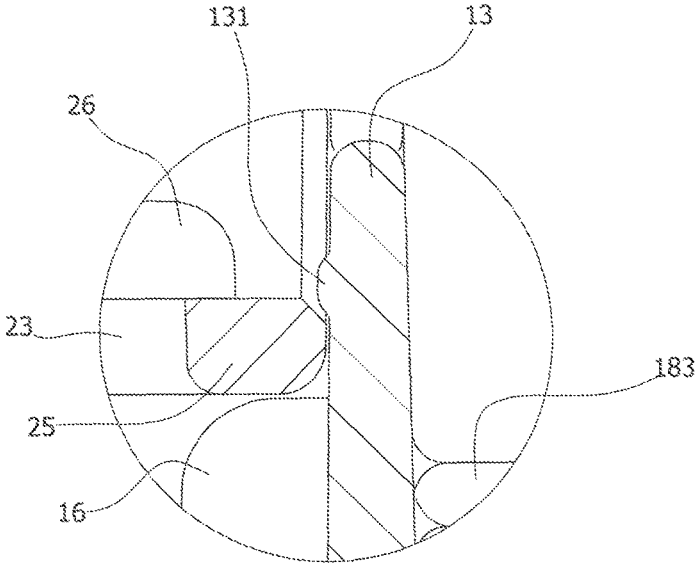
FIG. 10 is an enlarged schematic view of symbol "a" of FIG. 9 of the present invention.

As shown in FIGS. 9 and 10, a clamping block 131 protrudes from the inner wall of back sidewall 13 of the base 1. The clamping block 131 can clamp the top bar 25 on one side of building block base 2, so that the building block base 2 can be fixed into base 1 by the clamping block 131, it will not drop out due to impact or shake, and the clamping block 131 is an arcwise projecting lug. Therefore, as long as the player pulls up the building block base 2, the building block base 2 can be separated from the base 1.

Figure 11:
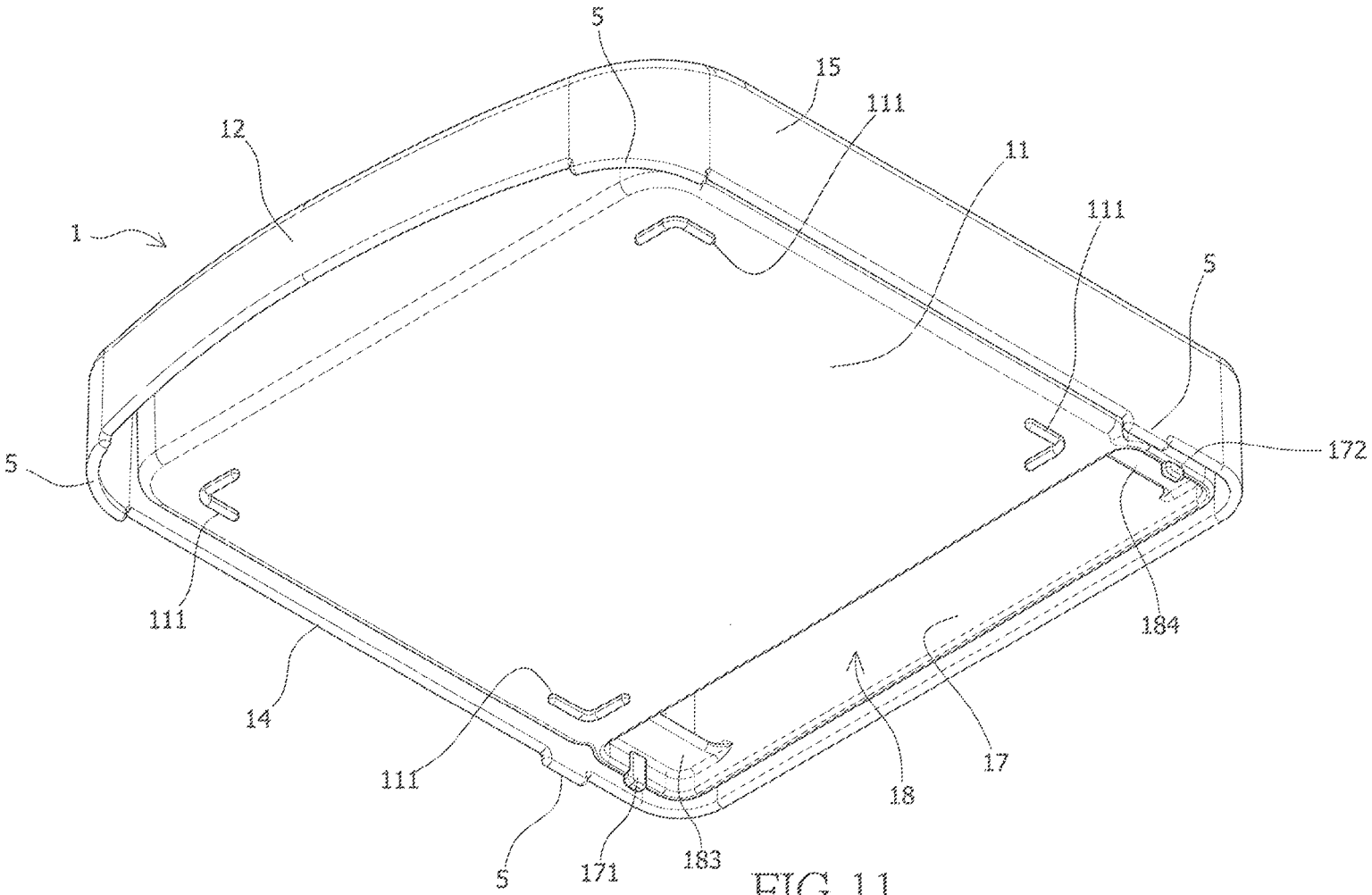
FIGS. 11 and 12 are schematic views of storage and stacking of the present invention.
Figure 12:
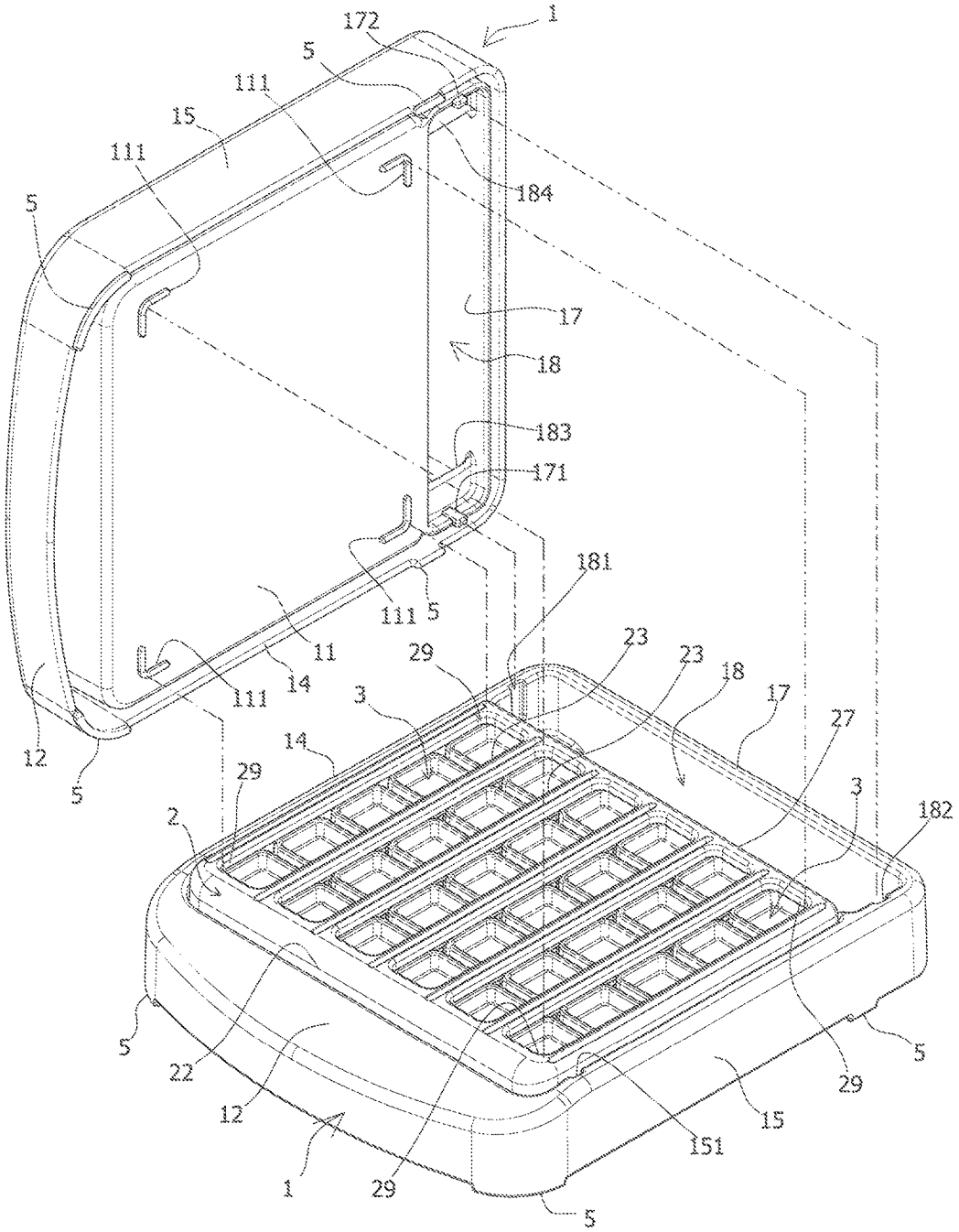

As shown in FIG. 11 and FIG. 12, a first and second stoppers 171, 172 corresponding to the third and fourth embedding grooves 181, 182 which can be embedded in the third and fourth embedding grooves 181, 182 protrude from the bottom of the handle 17 respectively, a third stopper 111 protrudes from four corners at the bottom of bottom board 11 respectively, an arc angle 29 corresponding to the third stopper 111 for embedding the third stopper 111 is located in the four corners on the surface of building block base 2 respectively. As the first, second and third stoppers 171, 172, 111 can be embedded in the third and fourth embedding grooves 181, 182 and the four arc angles 29 of building block base 2, several bases 1 can be stacked up vertically to save the storage space.

Please refer to FIG. 11 and FIG. 12, at least one antislip lug 5 protrudes from the bottom of the left and right sidewalls 14, 15 respectively, helpful to steady placement of the base 1 on the table top, so as to avoid the slip influencing the game.

Figure 13:
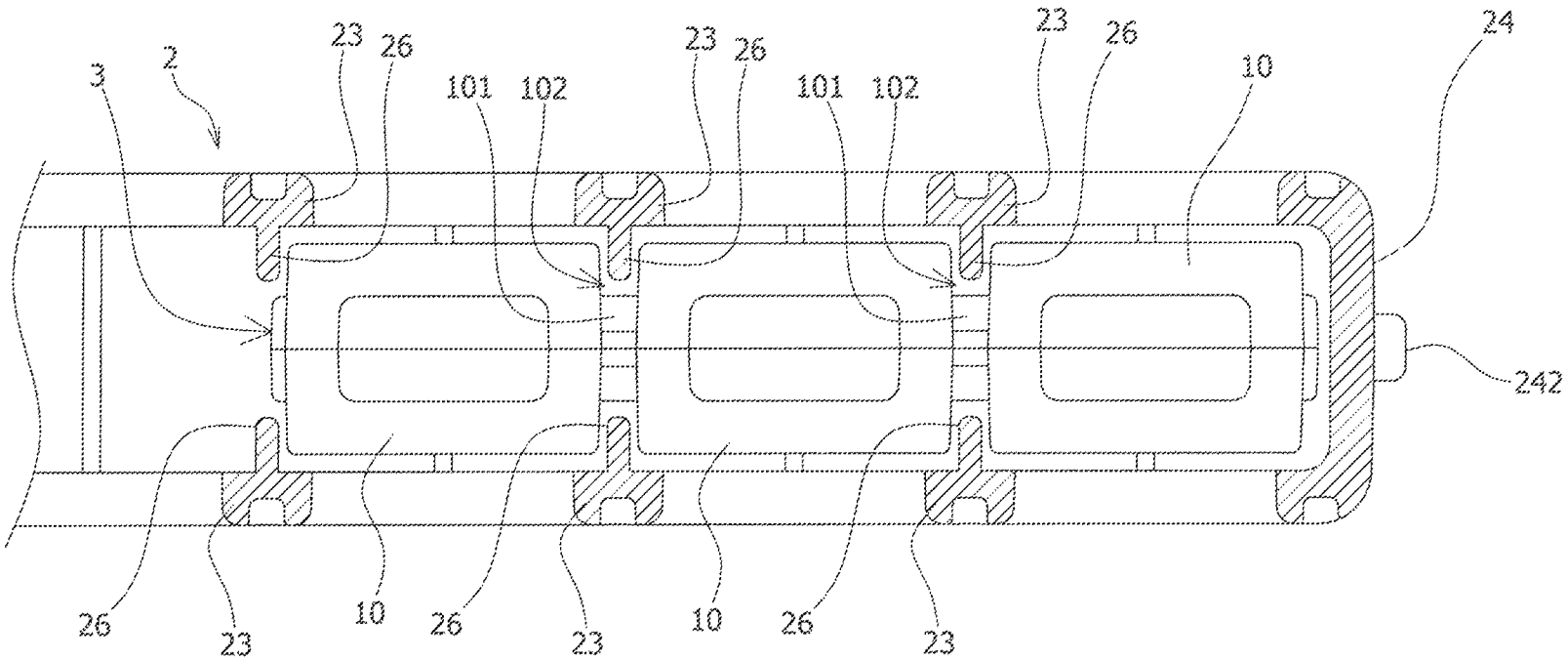
FIGS. 13 and 14 are schematic views of moving building blocks with fingers.
Figure 14:
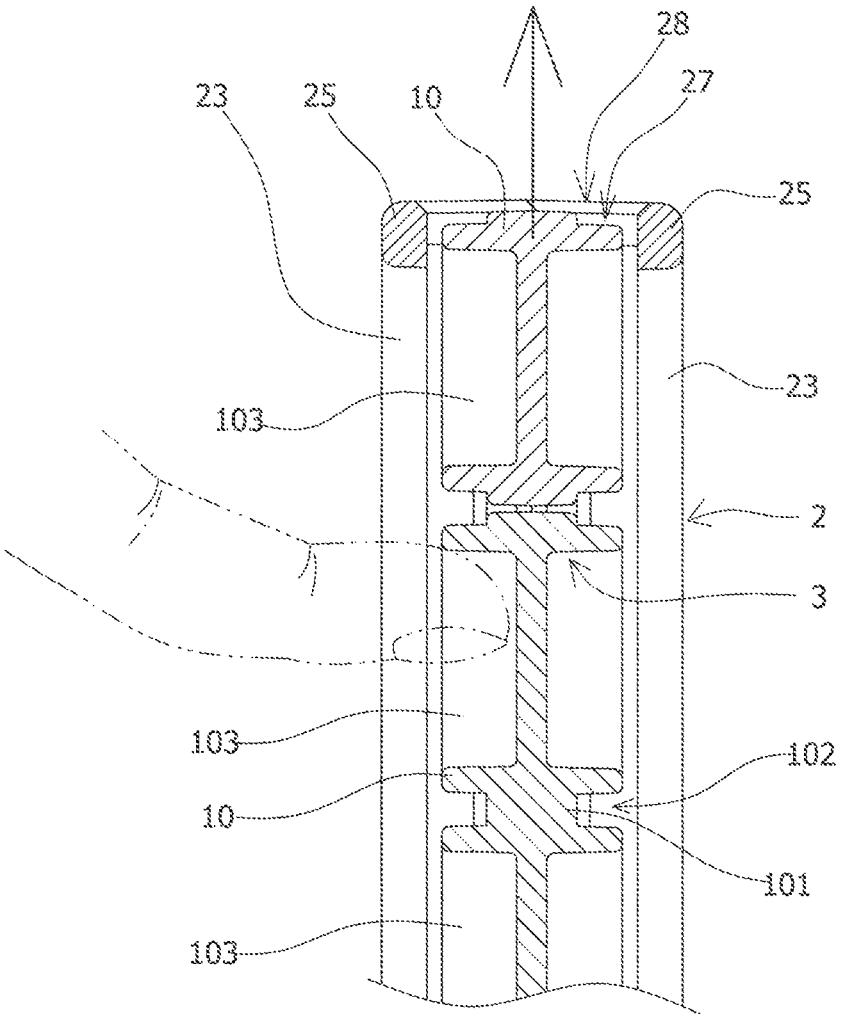

As shown in FIG. 13 and FIG. 14, each surface of the block unit 10 sinks inward to form a groove 103, the groove 103 enables the finger to pull up the building block A in the guide slot 27 easily.

Figure 15:
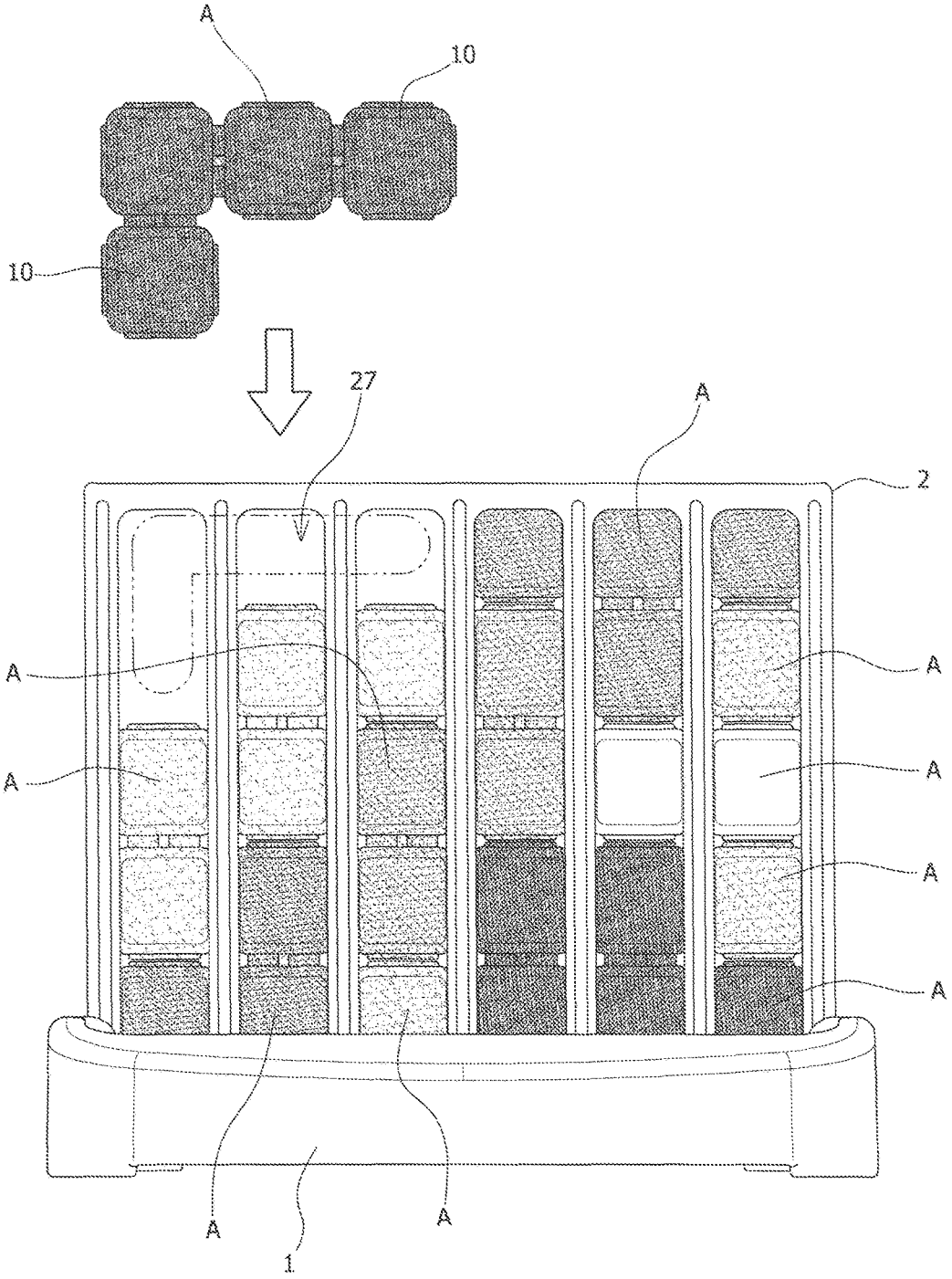
FIGS. 15 to 17 are schematic views of playing the present invention.

There are multiple ways to play this project, please refer to FIG. 15, the player shall think about how to place the building block A vertically in the guide slot 27, and to fill up the guide slot 27 without exceeding the building block base 2, the game is like the Tetris, this is the single-player game.

Figure 16:
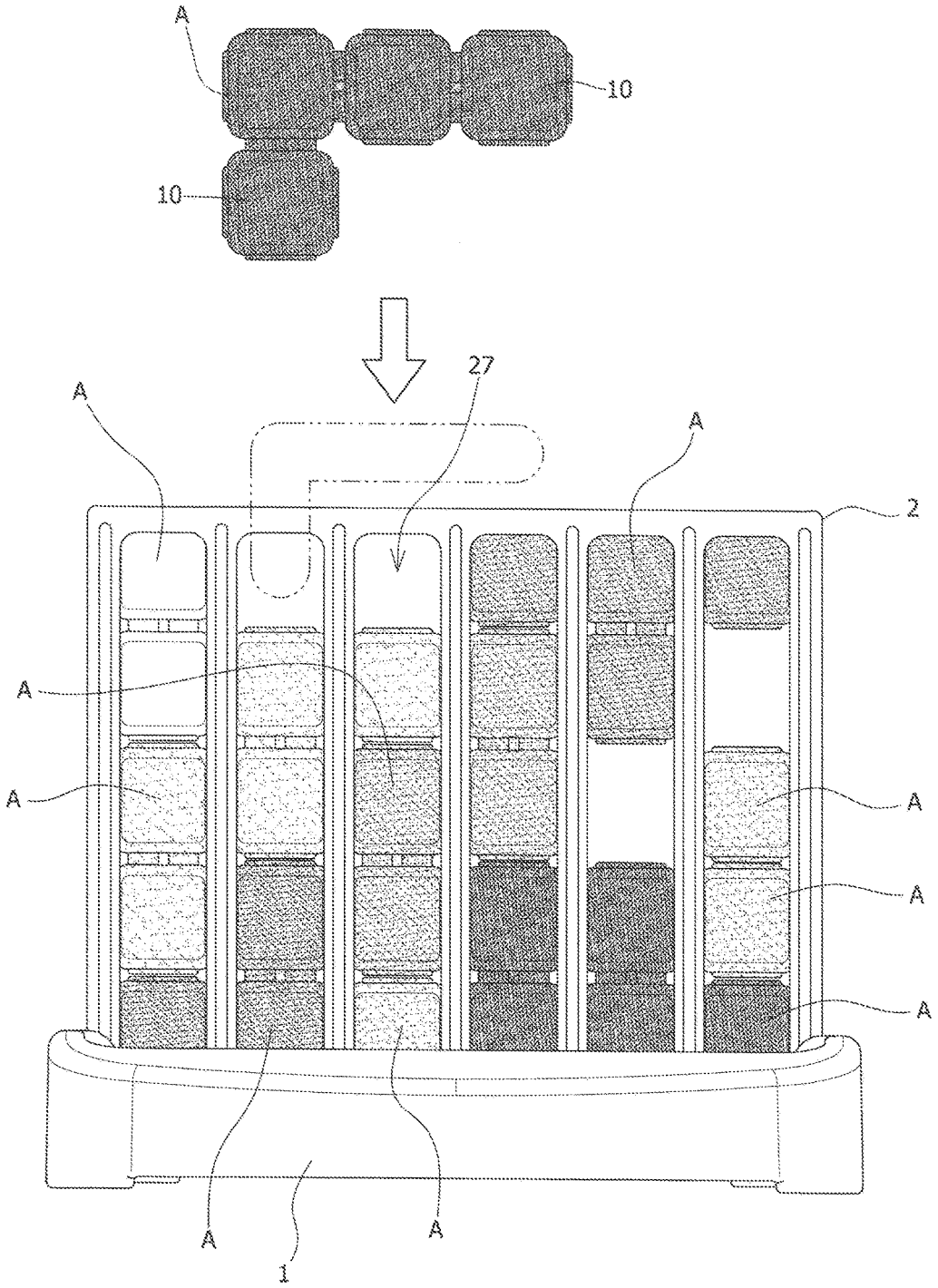

Afterwards, please refer to FIG. 16, two players sit face to face and play the educational game together, two players place the building block A in the guide slot 27 by turns, when one player's building block A cannot be placed in guide slot 27 and comes out of the building block base 2, he is the losing side, and the other side is the victor. This is the two-player game, so as to enhance the content and gameplay of this game to excite the interest and benefit of play.

Figure 17:
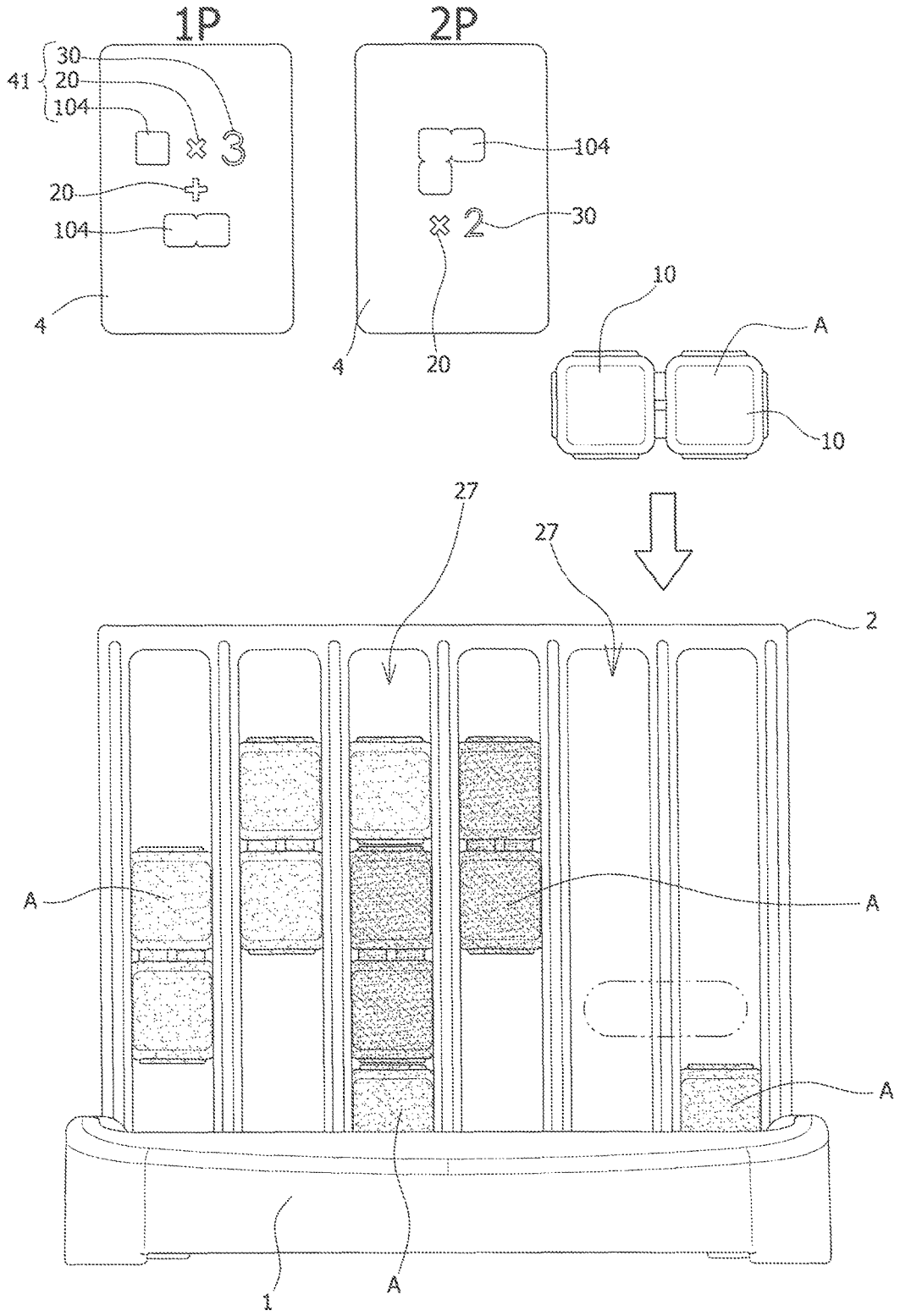

Finally, please refer to FIG. 17, two players sit face to face and play the educational game together. Each player draws a picture card 4, the pattern 41 on picture card 4 is taken as the game subject, the two players place the building block A in the guide slot 27 by turns, and think about how to complete the permutations and combinations as many as pattern 104 after the building block A is placed in guide slot 27. For example, in this case, there are two patterns 104 on the 2P picture card 4, so there must be two permutations and combinations identical with pattern 104 in the guide slot 27 after the 2P place the building block A in the guide slot 27, so as to win the game, this is how the two-player game is played. As this game play is more difficult, it is suitable for exciting the player's brain, till the winner comes out, there will be brain storming in the process, the educational function is implemented.

There is the play method of Tetris among previous educational games, but there is not yet a play method combining the building blocks with the building block base grid bars for permutation and combination of building blocks in a confined space. Therefore, the present invention makes the building block game more changeful, generating multiple plays, the difficulty level increases, so as to enhance the fun of building block game, and to implement the educational function of fun games and brain storming.

The above only describes some exemplary embodiments of the present invention. Those having ordinary skills in the art may also make many modifications and improvements without departing from the conception of the invention, which shall all fall within the protection scope of the invention.

I claim:

1. A vertically stacked educational building block device, comprising: a base (1), including a bottom board (11); front and back sidewalls (12, 13) upright on front and back sides of the bottom board (11); and left and right sidewalls (14, 15) upright and connected to front and back sidewalls (12, 13) on right and left sides of the bottom board (11); wherein the front and back sidewalls (12, 13) include a plurality of protruding stoppers (16) disposed thereunder; the back sidewall (13) includes a handle (17), and two ends of the handle (17) are integrally formed with the left and right side walls (14, 15) of the base (1), so that a receiving groove (18) is formed between the handle (17) and back sidewall (13); a building block base (2), which can be placed in the base (1), and withstood by the stopper (16), so that the building block base (2) is spaced from the bottom board (11) to form a holding space (21), and the building block base (2) including a bottom wall (22); wherein the building block base (2) includes a bottom wall (22), a plurality of parallel and equidistantly arranged grid bars (23) located on two sides of a top end of the bottom wall (22), two sidewalls (24) located at both ends of bottom wall (22), two top bars (25) connected to a top end of the grid bars (23) and sidewalls (24), and a retaining wall (26) protruding from an inner wall of the grid bars (23); the retaining wall (26) forms a plurality of guide slots (27) between two rows of grid bars (23), one end of the guide slot (27) is the slot opening (28), and another end is sealed by the bottom wall (22); a building block set (3), including a plurality of building blocks (A) vertically located in the guide slot (27) of the building block base (2); wherein the building block (A) contains at least one block unit (10); the block units (10) are connected by a narrow neck (101), so a groove (102) is formed between the block units (10), so that the building block (A) can be moved vertically in the guide slot (27) with the groove (102) and the retaining wall (26) on two rows of grid bars (23); and at least one picture card (4), which can be laid in the holding space (21), and at least one pattern (41) is printed on a surface of picture card (4).

2. The vertically stacked educational building block device according to claim 1, wherein one end of the left and right sidewalls (14, 15) near the front sidewall (12) includes arc-like first and second embedding grooves (141, 151) respectively; the first and second embedding grooves (141, 151) includes vertically connected transverse grooves (1411,

1511) and longitudinal grooves (1412, 1512) respectively; a first and second locating pieces (241, 242) corresponding to the first and second embedding grooves (141, 151) protrude from both ends of the sidewall (24) of the building block base (2) respectively, the first and second locating pieces (241, 242) can be embedded in the first and second embedding grooves (141, 151) respectively, so that the building block base (2) can be slid into the base (1) via the first and second embedding grooves (141, 151), and vertically swayed toward the handle (17) to be placed flat in the base (1).

3. The vertically stacked educational building block device according to claim 1, wherein a third and fourth embedding grooves (181, 182) are located in left and right end walls of the receiving groove (18) respectively, and first and second locating pieces (241, 242) at both ends of sidewall (24) can be embedded in the third and fourth embedding grooves (181, 182) respectively, so that the building block base (2) can stand upright in the receiving groove (18) between the handle (17) and back sidewall (13).

4. The vertically stacked educational building block device according to claim 3, wherein a first and second baffles (183, 184) extend inward at a bottom of left and right end walls of the receiving groove (18) respectively; the first and second baffles (183, 184) can be propped the bottom of building block base (2) respectively, so that the building block base (2) is supported by the first and second baffles (183, 184) to stand upright in the receiving groove (18).

5. The vertically stacked educational building block device according to claim 2, wherein a first and second stoppers (171, 172) corresponding to third and fourth embedding grooves (181, 182) which can be embedded in the third and fourth embedding grooves (181, 182) protrude from a bottom of the handle (17) respectively, and a third stopper (111) protrudes from four corners at the bottom of the bottom board (11) respectively, and an are angle (29) corresponding to the third stopper (111) for embedding the third stopper (111) is located at four corners on a surface of building block base (2) respectively.

6. The vertically stacked educational building block device according to claim 1, wherein at least one anti-slip lug (5) protrudes from a bottom of the left and right sidewalls (14, 15) respectively.

7. The vertically stacked educational building block device according to claim 1, wherein a clamping block (131) protrudes from an inner wall of back sidewall (13) of the base (1), the clamping block (131) can clamp the top bar (25) on one side of the building block base (2), so that the building block base (2) is fixed into the base (1), and the clamping block (131) is an arc-like projection.

8. The vertically stacked educational building block device according to claim 1, wherein each surface of the block unit (10) is recessed inwardly to form a groove (103) for finger movement.

* * * * *